US005562189A

United States Patent [19]

Chen

[11] Patent Number: 5,562,189

[45] Date of Patent: Oct. 8, 1996

[54] LUGGAGE WITH PIVOTING PULL STRAP

[75] Inventor: Michael Chen, Taipei, Taiwan

[73] Assignee: Swire & Maclaine Limited Taiwan Branch (H.K.), Taipei, Taiwan

[21] Appl. No.: 371,977

[22] Filed: Jan. 12, 1995

[51] Int. Cl.[6] ..... A45C 13/26

[52] U.S. Cl. ..... 190/115; 190/39

[58] Field of Search ..... 190/115, 39, 116, 190/117; 16/112 R, 110 B, 115

[56] References Cited

U.S. PATENT DOCUMENTS

| | | | |
|---|---|---|---|
| 2,031,218 | 2/1936 | Klotz | 190/115 |
| 2,392,926 | 1/1946 | Kelly | 190/115 |
| 3,653,474 | 4/1972 | Sadow | 190/115 X |
| 4,838,396 | 6/1989 | Krenzel | 190/115 X |
| 4,966,259 | 10/1990 | Bergman | 190/115 X |
| 5,350,046 | 9/1994 | Falloon et al. | 190/115 |

FOREIGN PATENT DOCUMENTS

| | | | |
|---|---|---|---|
| 5176809 | 7/1993 | Japan | 190/115 |
| 998492 | 7/1965 | United Kingdom | 190/115 |

*Primary Examiner*—Sue A. Weaver
*Attorney, Agent, or Firm*—Bacon & Thomas

[57] ABSTRACT

The present invention relates to a trunk pulling structure that has a simple structure and achieves overall beauty, easy production, low cost, convenience and a nice outlook. The pull strap is attached to a side of the trunk and made from cloth sheet, sewn around a bracing bar, having a hold hole and handle bar. An inner side has a fastener strip on the trunk. The trunk can be pulled with the pull strap, and when not in use, the pull strap can be fastened to the trunk by the cooperating fastener strips.

4 Claims, 3 Drawing Sheets

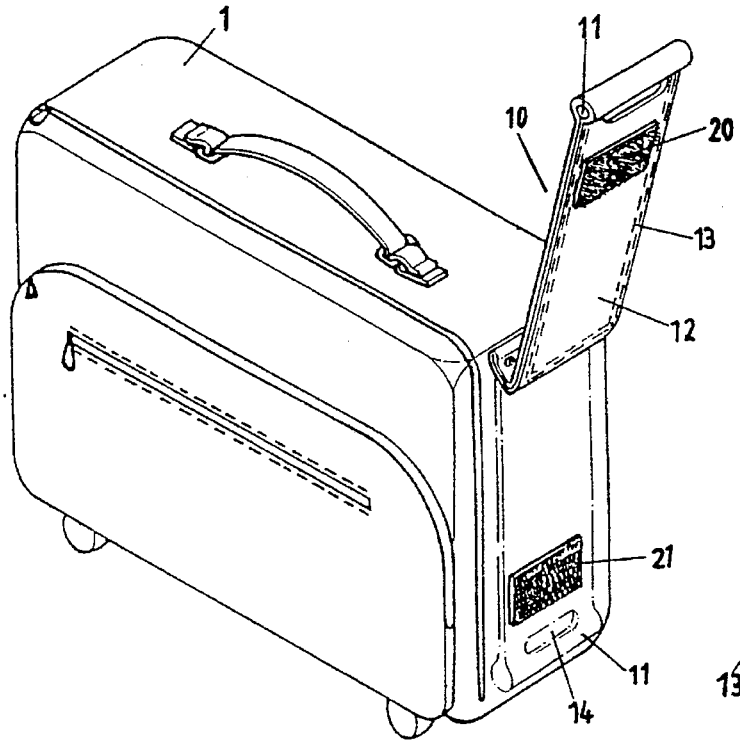
FIG.2 A
FIG.2 B
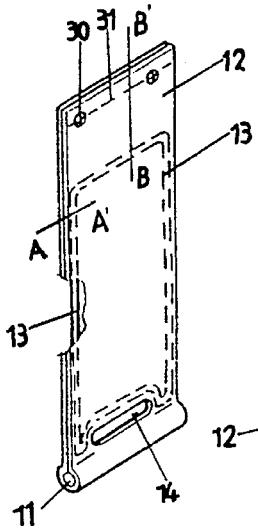
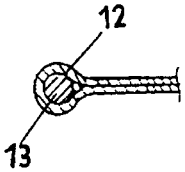
FIG.2 C
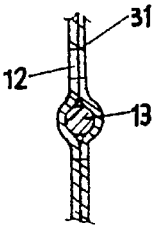
FIG.2D

LUGGAGE WITH PIVOTING PULL STRAP

The present invention relates to a luggage or trunk pulling structure, more particularly to a trunk pulling structure that may function to pull a trunk by means of a cloth sheet and may integrate with the trunk to achieve overall beauty and have the effect of easy production, low cost, convenience and a nice outlook.

There are a wide variety of pull straps for trunks, although there are two major kinds: (I) a pull link type, wherein an extensible pull link consists of a metal loop bar (as there are various types of pull straps, they cannot all be described here). It can be understood this type has the following defects: (1) metal members increase the weight and cost of the trunk and its dimensions; (2) to reach its extended position requires a very complicated structure which increases production labor, time and cost; and (3) it cannot be changed in angle for pulling to match different heights of users. (11) In another type, as shown in FIG. 1, a trunk has a retaining ring 2, with a pull strap 3 for pulling the trunk. Though it is simple in structure, it has the following defects: (1) straight-line pulling could cause gravity deflection of trunk 1 and thus cause the trunk 1 to overturn due to joggling; (2) the holding area of pull strap 3 is small, causing pain to the user when pulling heavy goods; (3) pull strap 3 is easily broken; and, (4) pull strap 3 cannot be hidden when not used to achieve beauty. All conventional devices have defects with regard to bulk, weight, production cost, durability and practical use.

These and other objects and advantages of the present invention will become apparent to those skilled in art after considering the following detailed specification together with the accompanying drawings.

BRIEF DESCRIPTION OF THE DRAWINGS

FIG. 2A is a perspective view of a trunk having a pull strap according to the present invention.

FIG. 2B is a perspective view of the pull strap of FIG. 2A.

FIG. 2C is a cross-sectional view taken along line A—A' in FIG. 2B.

FIG. 2D is a cross-sectional view taken along lines B—B' in FIG. 2B.

DETAILED DESCRIPTION OF PREFERRED EMBODIMENT

Figure 1:
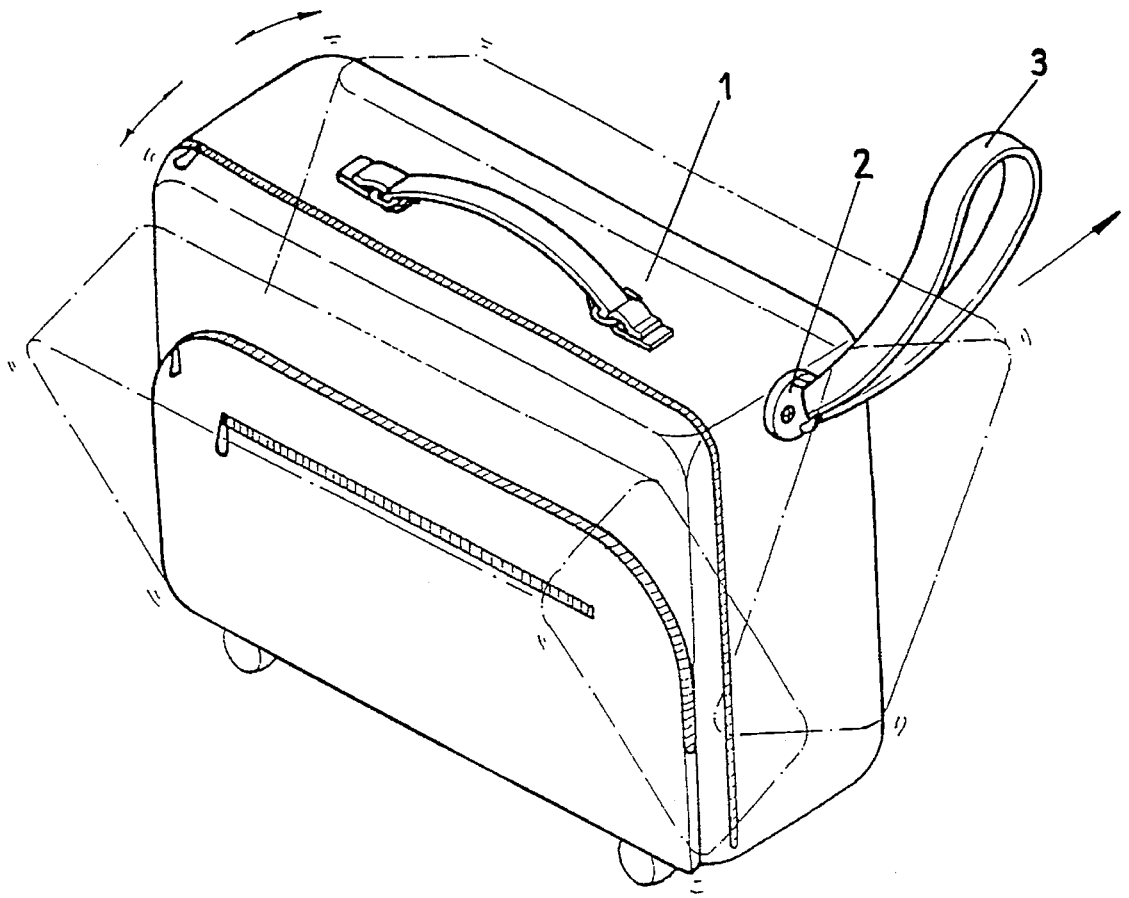
FIG.1 PRIOR ART
FIG. 1 is a perspective view of a conventional device.

Referring to FIG. 2, a trunk 1 has pull strap 10 attached to a side, the trunk 1 and the pull strap 10 being connected by rivets 30 and sewn together by thread 31. Said pull strap 10 is a cloth sheet 12, sewn around bracing bar 13. A distal end has a hold hole 14 and a handle bar 11, the inner side having fastener strip 20. A position on trunk 1 corresponding to fastener strip 20 has cooperating fastener strip 21. A trunk pulling device is thus achieved. The use, effect and advantage of the present invention is described below:

(1) Bracing bar 13 causes the cloth sheet 12 of pull strap 10 to remain flat and to evenly distribute the pulling force.

(2) When pulling, the holding bar 11 distributes the pulling force so the engaged hand will not feel painful.

(3) When pulling, cloth sheet 12 is flat to achieve a balanced and stable operation rendering the trunk not easy to overturn.

(4) When in use, cooperating fastener strips 20, 21 of pull strap 10 and trunk 1 will be disengaged from each other, pull strap 10 may assume any appropriate angle to adapt to the height of user.

(5) When not in use, cooperating fastener strips 20, 21 of pull strap 10 and trunk 1 will be joined together enabling pull strap 10 to tightly lay against the side of trunk 1. The use of same cloth material on the pulling strap and the trunk may achieve overall beauty.

(6) The structure of cloth sheet 12 is light in weight and easy for production thereby saving space and minimizing productions costs.

Figure 3:
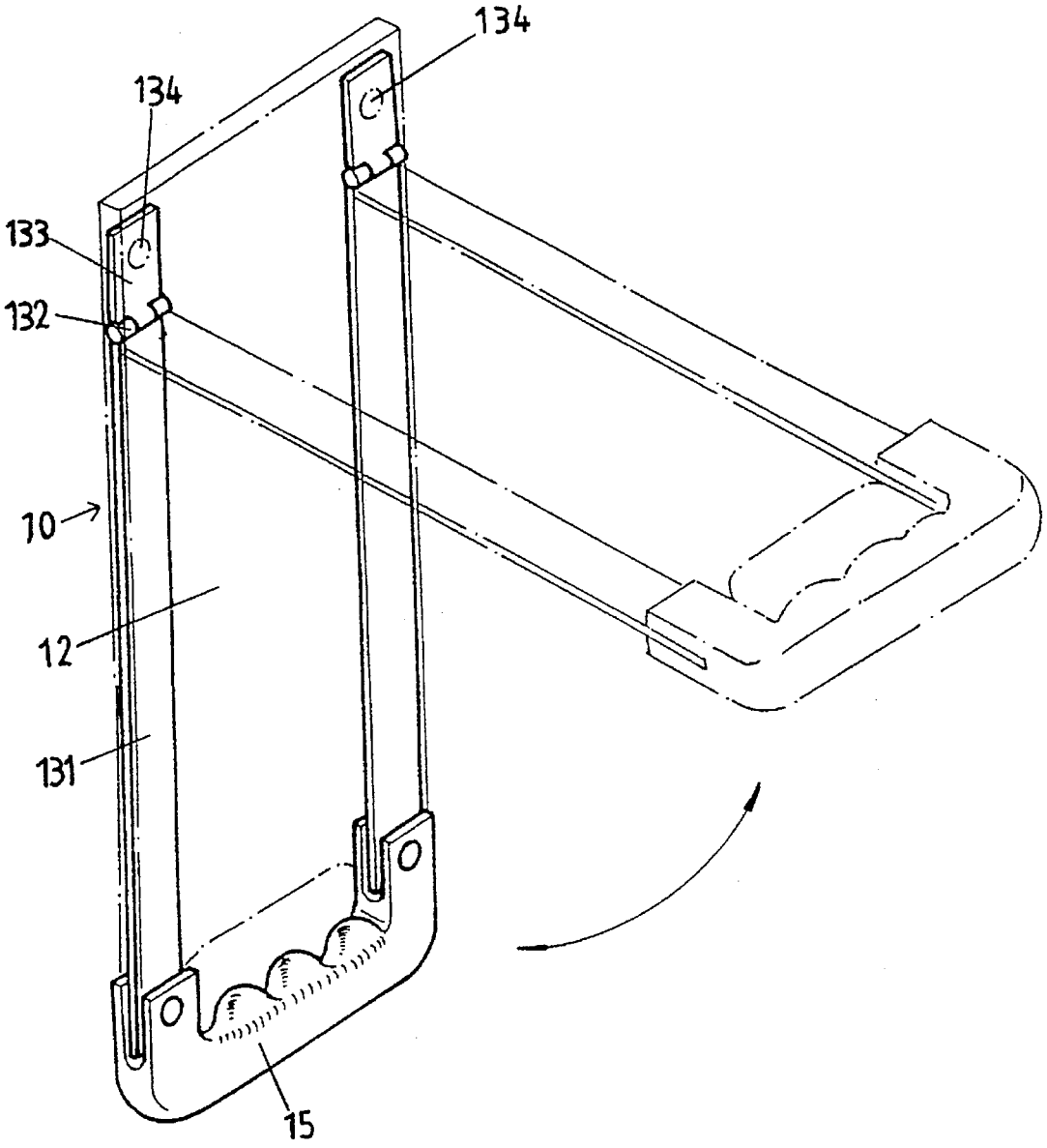
FIG. 3 is a perspective view of another embodiment of the pull strap according to the present invention.

Referring to FIG. 3, each side of said pull strap 10 has a steel sheet 131 in substitute of bracing bar 13. One end of steel sheet 131 is attached by pivot 132 to a back plate 133, said back plate 133 having a round hole 134 for joining together with the trunk body 1 by means of a rivet, enabling the pull strap 10 to swing up and down to facilitate the operation by the user. On the other end of steel sheet 131 is attached together with cloth 12, a handle 15, assembled together by means of rivets. Said steel sheet 131 is provided for increasing the structural strength and stiffness of said pull strap 10 so as to prevent pull strap 10 from tumbling or bending when the trunk body is turning so that the trunk body can be pulled securely.

To conclude the above-said statement, the present invention breaks through the conventional trunk pulling structure, has a simple structure to make it each for production, to decrease additional weight and to adapt to the height of user to facilitate stable usage.

I claim:

1. A pull strap for luggage such as a trunk having a side comprising:

a) bracing means comprising a pair of spaced apart bracing elements;

b) a cloth sheet enclosing the bracing means so as to form an elongated pull strap having first and second ends;

c) a handle bar extending across the pull strap adjacent to said first end thereof to form a handle to be gripped by a user;

d) means to pivotally secure the second end of the pull strap to the side of the luggage;

e) a first fastener strip located on the pull strap; and, f) a second cooperating fastener strip located on the side of the luggage positioned so as to releasably engage the first fastener strip to hold the pull strap against the side of the luggage.

2. The pull strap of claim 1 wherein the pair of spaced apart bracing elements comprise opposite sides of a bracing bar having a closed loop configuration.

3. The pull strap of claim 2 wherein the closed loop configuration of the bracing bar includes opposite end crossmembers, a first of the crossmembers located adjacent to the first end of the pull strap and a second of the crossmembers spaced from the second end of the pull strap.

4. The pull strap of claims 1 further comprising a back plate pivotally attached to an end of each bracing element whereby the back plates are attached to the side of the luggage by rivet means.

* * * * *